US005655740A

United States Patent [19]

Lazarus

[11] Patent Number: 5,655,740

[45] Date of Patent: Aug. 12, 1997

[54] SHELVING SUPPORT SYSTEM

[76] Inventor: Abraham M. Lazarus, 52A Sachlay St., Ramat Poleg, Netanya, Israel

[21] Appl. No.: 582,879

[22] Filed: Jan. 4, 1996

[30] Foreign Application Priority Data

May 18, 1995 [IL] Israel ..... 113771

[51] Int. Cl.[6] ..... A47G 29/02

[52] U.S. Cl. ..... 248/243; 108/108; 211/187; 211/90.02; 248/250; 248/303; 403/4; 403/386

[58] Field of Search ..... 248/241, 243, 248/245, 235, 239, 249, 250, 220.43, 222.11, 303; 211/90, 103, 187; 108/107, 108; 403/3, 4, 386, 400

[56] References Cited

U.S. PATENT DOCUMENTS

| | | | |
|---|---|---|---|
| 365,690 | 6/1887 | Kochsmeier | 248/249 |
| 704,154 | 7/1902 | Walker | 248/249 |
| 2,244,977 | 6/1941 | Hansman et al. | 24/24 X |
| 2,471,839 | 5/1949 | Schumacher | 248/239 X |
| 2,657,894 | 11/1953 | Sklenar | 248/239 |
| 3,905,712 | 9/1975 | McConnell | 248/243 X |
| 4,777,888 | 10/1988 | Waterman et al. | 248/250 X |
| 4,834,555 | 5/1989 | Grass | 248/243 X |
| 5,183,167 | 2/1993 | Cheng | 211/187 |

FOREIGN PATENT DOCUMENTS

| | | | |
|---|---|---|---|
| 1429475 | 4/1969 | Germany | 248/243 |
| 541908 | 6/1941 | United Kingdom | 248/239 |

*Primary Examiner*—Ramon O. Ramirez
*Attorney, Agent, or Firm*—Edward Langer

[57] ABSTRACT

A sturdy, easily constructed shelving support system for homes, stores and offices. The system uses shelf hangers and wall brackets, employing a novel, push-fit interlocking connector. The shelf hanger is fabricated as a rigid wire member, bent into a V-shape and connected at its ends to a right angled upright member by the push-fit connector locked into a square opening formed In the upright. The lower leg of the shelf hanger is suspended by the support leg, with its end portion flush against the upright wall, so that It does not rotate, to provide a stable support for a shelf end. The push-fit connectors are easily locked into the openings In the upright member, and may be quickly removed and re-positioned, enabling quick and easy construction of an entire shelving system within minutes, or easy alteration of its layout. A feature of the invention is that in addition to its support function, the support leg acts as a shelf book-end. Another feature Is that the shelving support system may be constructed to provide continuous shelving space using sets of shelf hangers to support shelves end-to-end. The adjoining shelves may also be arranged at different heights. Different types of shelving material may be used, including metal, metal wire grid, plastic, or wood types. Many different wall-supported or free-standing units can be designed.

13 Claims, 14 Drawing Sheets

SHELVING SUPPORT SYSTEM

FIELD OF THE INVENTION

The present invention relates to shelving systems as may be used In stands of various types, wall-mounted shelves and the like, and more particularly, to a shelving support system having wire-shaped shelf hangers connected at their ends to wall brackets by push-fit removable connectors which can be oriented as desired, for quick assembly of various shelving systems.

BACKGROUND OF THE INVENTION

A large number of different types of shelving assemblies are known and have been constructed, however, there is a continuous need for shelving assemblies that may be constructed of fewer and simpler mass-produced parts, offering reduced costs, to provide more convenient assembly according to a wide variety of possible designs, with a more sturdy construction.

Shelving systems are typically provided as knock-down kits for assembly at the user's location, thus minimizing shipping costs by avoiding the need to transport bulky assemblies. Assembly of these units then becomes the task of the user, who is typically unfamiliar with the assembled design, and this requires the location and identification of a multitude of parts, and an understanding of packaged instructions concerning their assembly. The problems with this approach are based on complicated prior art designs, which do not lend themselves to quick construction.

Prior art attempts to simplify shelving system construction include the system described in U.S. Pat. No. 5,348,170 to Thornley et al. A free-standing shelving system is disclosed, having uprights formed with a slot for shelf edges to be inserted, forming an aperture into which a locking peg is fitted.

In U.S. Pat. No. 4,757,769 to Suttles, a shelving unit is described in which corner hinges are welded to connecting elements to form rectangualar modules for supporting shelves. The modules can be stacked to achieve a desired height.

A technique of construction using a plurality of upright posts is described in U.S. Pat. No. 4,585,365 to Manno. The upright posts have a coaxial bore into which the ends of horizontal beams extend, each beam having a tongue fitting into the bore, with a dowel pin locking them together.

An adjustable shelving system is disclosed in U.S. Pat. No. 3,981,250 to Anthony, in which shelves are provided with corner notches through which upright posts are fitted and locked by a releasable screw.

In U.S. Pat. No. 3,480,155 to Ferdinand, lightweight steel shelving is disclosed in which short sections of corner posts are snap assembled in end-to-end relationship. The posts are held together by a shouldered detent formed in a wall of one post, which slides into and engages an aperture in the connected post.

An additional popular shelving system utilizes a metal bracket formed with hooks at one end which engage a wall bracket, such as manufactured by ENDEL and available from IKEA furniture.

With the rise in do-it-yourself building supply centers for home and commercial needs, and increasing consumer demand for such products, easy to assemble shelving systems are required more than ever before. In general, prior art systems use intricate fittings, or are complicated and not easily constructed.

Therefore, it would be desirable to provide a quick and easy to assemble shelving system with maximum adjustment features.

SUMMARY OF THE INVENTION

Accordingly, it is a principal object of the present invention to overcome the above-mentioned disadvantages of prior art shelving systems and provide a quickly and easily assembled shelving support system using shelf hangers and wall brackets, employing a novel, push-fit interlocking connector.

In accordance with a preferred embodiment of the present invention, there is provided a shelving support system comprising:

an upright member defining a vertical support;

a V-shaped shelf hanger having legs for attachment of both open ends thereof to said upright member; and a pair of connector means for connecting, respectively, an upper support leg and a lower leg of said V-shaped shelf hanger to said upright member such that said shelf hanger extends from said upright member, said lower leg being connected to said upright member in non-rotatable fashion and being suspended substantially horizontal thereto by the upper support leg for supporting a shelf end resting thereon.

In a preferred embodiment, the shelf hanger is fabricated as a rigid wire member, bent into a V-shape and connected at its ends to a right angled upright member by a push-fit connector locked into a square opening formed in the upright. The lower leg of the shelf hanger is suspended by the support leg, with its end portion flush against the upright wall, so that it does not rotate, to provide a stable support for a shelf end.

The push-fit connectors are easily locked into the openings in the upright member, and may be quickly removed and re-positioned, enabling quick and easy construction of an entire shelving system within minutes, or easy alteration of its layout.

A feature of the inventive design is that in addition to its support function, the support leg acts as a shelf book-end.

Another feature of the invention is that the shelving support system may be constructed to provide continuous shelving space using sets of shelf hangers to support shelves end-to-end. The adjoining shelves may also be arranged at different heights.

Different types of shelving material may be used, including metal, metal wire grid, plastic, or wood types. Many different wall-supported or free-standing units can be designed.

The inventive design features a sturdy, easily constructed shelving support system for homes, stores and offices.

Other features and advantages of the invention will become apparent from the following drawings and description.

BRIEF DESCRIPTION OF THE DRAWINGS

For a better understanding of the invention with regard to the embodiments thereof, reference is made to the accompanying drawings, in which like numerals designate corresponding elements or sections throughout, and in which.

DETAILED DESCRIPTION OF THE PREFERRED EMBODIMENTS

Figure 1B:
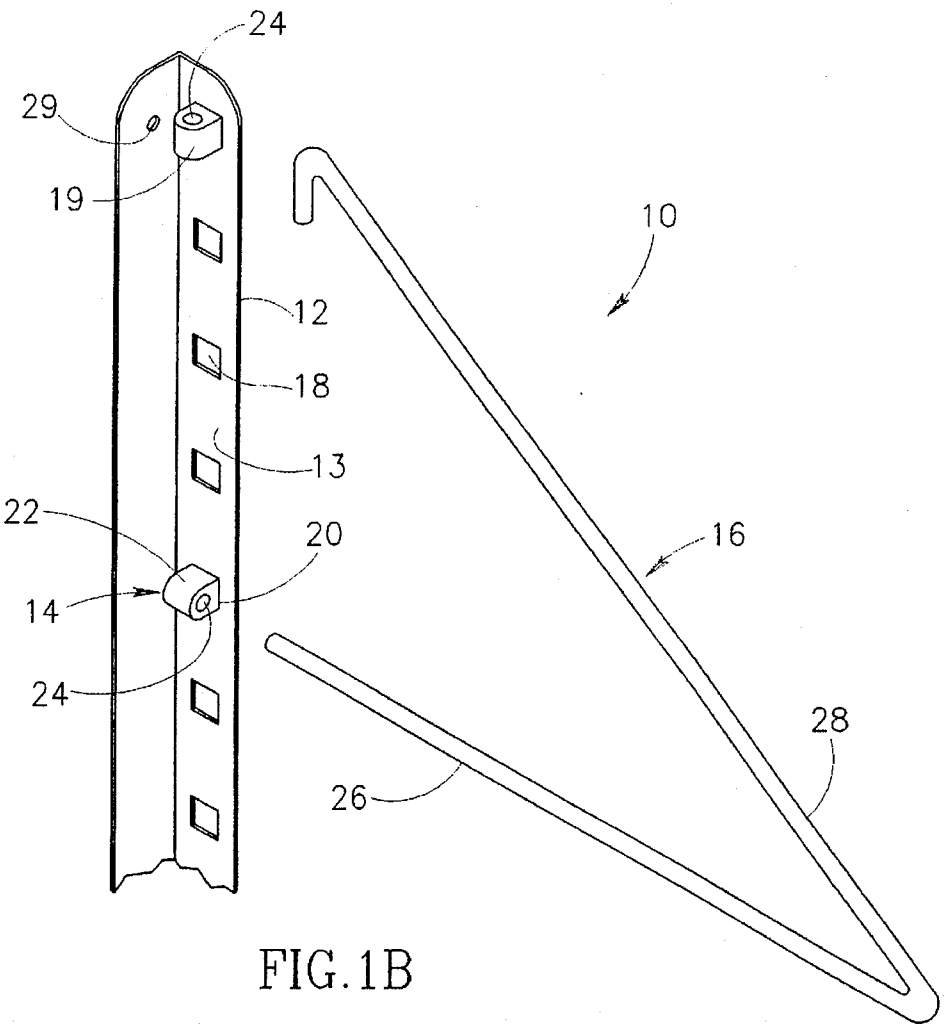
FIGS. 1*a–d* illustrate preferred embodiment of a shelving support system constructed in accordance with the principles of the present invention.

Referring now to FIGS. 1*a–d*, there are shown components for use in a shelving support system 10 constructed in accordance with the principles of the present invention. Shelving support system 10 comprises an upright wall bracket 12, a push-fit connector 14, and a shelf hanger 16. Wall bracket 12 is typically provided as an L-shaped bracket, with one face 13 formed with a plurality of square apertures 18 disposed vertically thereon. Push-fit connector 14 is shaped with an oversize head 15, so that it does not pass freely through aperture 18, but is retained therein. Connector 14 is designed to be load-bearing, and is shaped so that its upper portion 19 protrudes through aperture 18 and has a square base, with flat side faces 20, 22. Upper portion 19 is formed with a hole 24 extending therethrough.

Figure 1A:
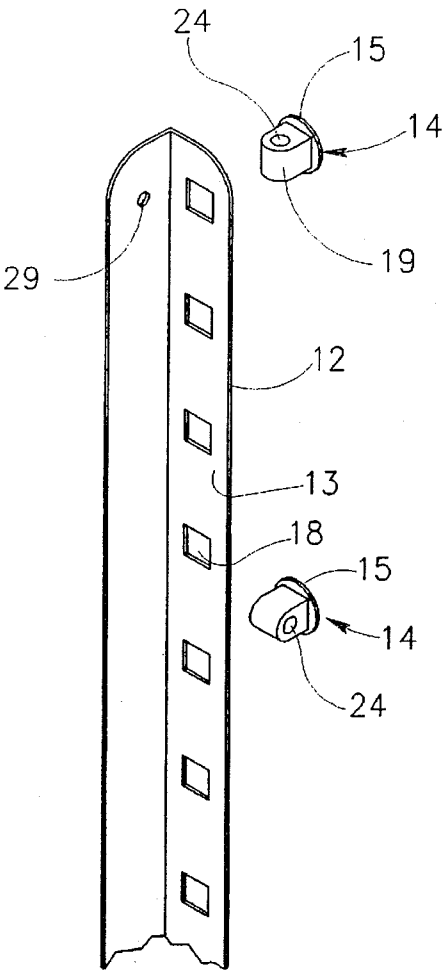
Figure 1C:
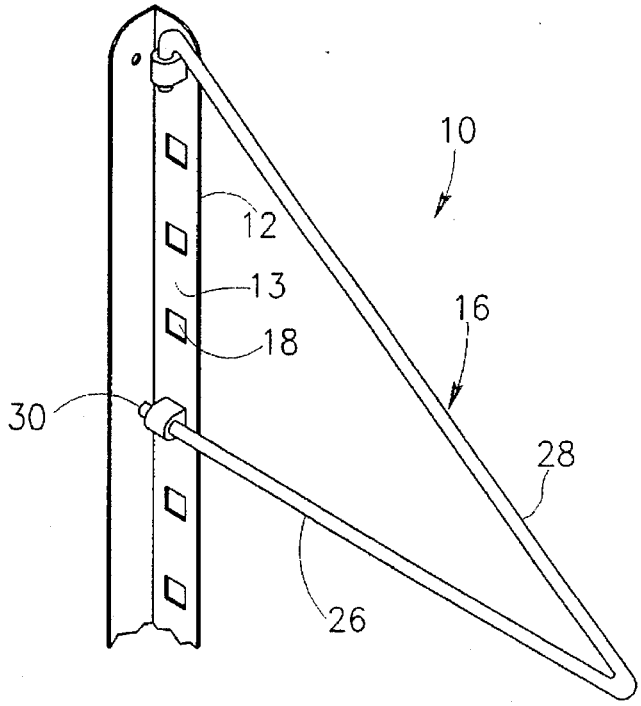

As shown in FIG. 1*a*, the upper one of the pair of push-fit connectors 14 is oriented so that hole 24 extends vertically, while in the lower one, hole 24 extends horizontally. Shelf hanger 16 is fabricated as a rigid wire member, having a lower leg 26 and a support leg 28 bent into a V-shape, with the lower leg 26 of shelf hanger 16 being suspended by support leg 28.

Figure 1D:
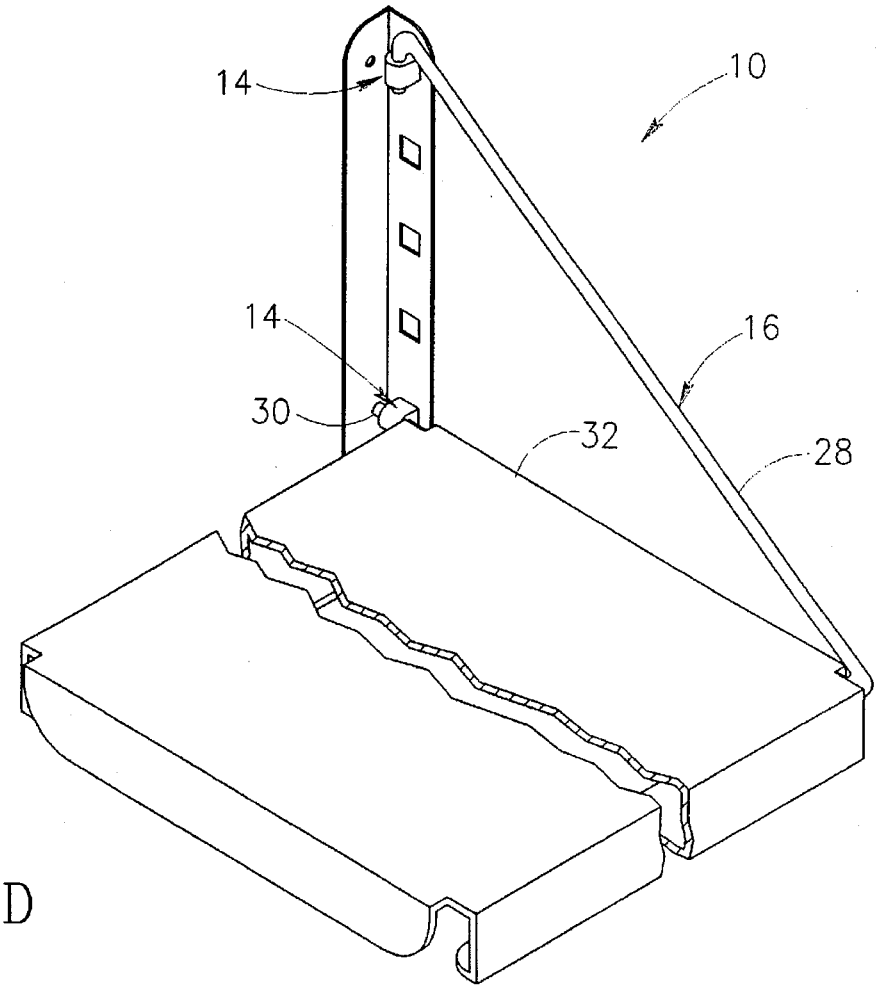

The end of support leg 28 is hook-shaped so that it passes through vertically oriented hole 24, to lock connector 14 in aperture 18, while simultaneously locking support leg 28 therein to provide support. Similarly, the end of lower leg 26 passes through horizontally oriented hole 24 in connector 14, until it abuts against wall bracket 12, providing a stop 30. Thus, the ends of shelf hanger 16 are orthogonal to one another, preventing side to side movement since lower leg 26 is maintained against inner face 13 of wall bracket 12 and does not rotate, providing a stable support for shelf 32 end, as shown in FIG. 1*d*. Inherently, hanger 16 provides additional system stability since lower leg 26 has a tendency to move further towards wall bracket 12 as shelf 32 loading increases.

Figure 1E:
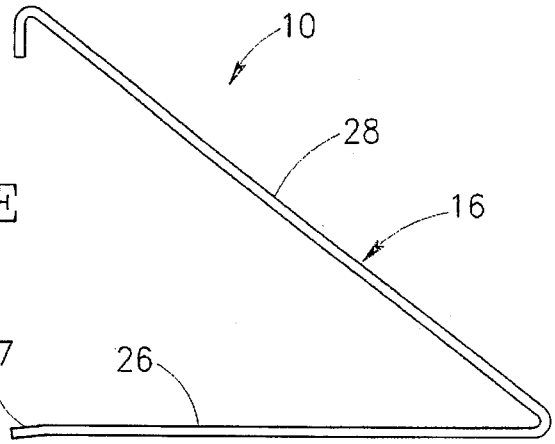
FIGS. 1*e–i* illustrate a modified support leg used as a component of the system of FIGS. 1*a–d;*
Figure 1F:
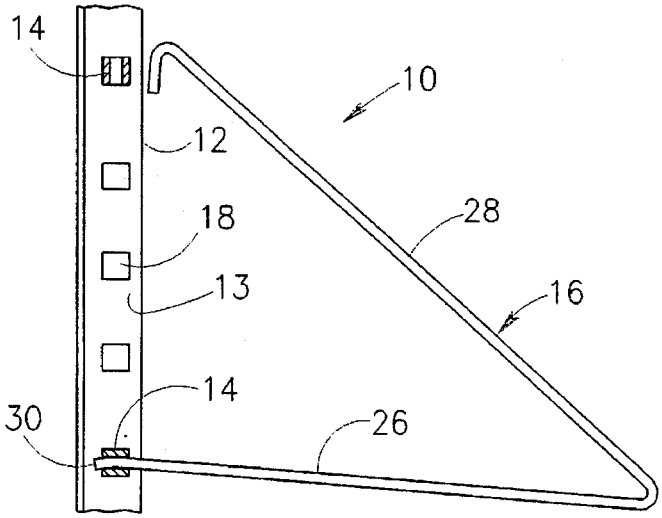
Figure 1G:
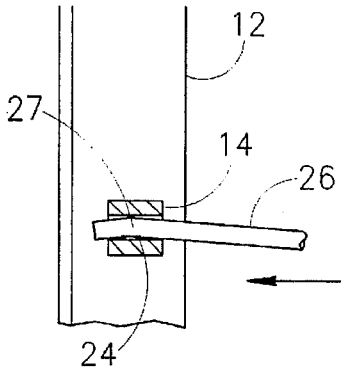
Figure 1H:
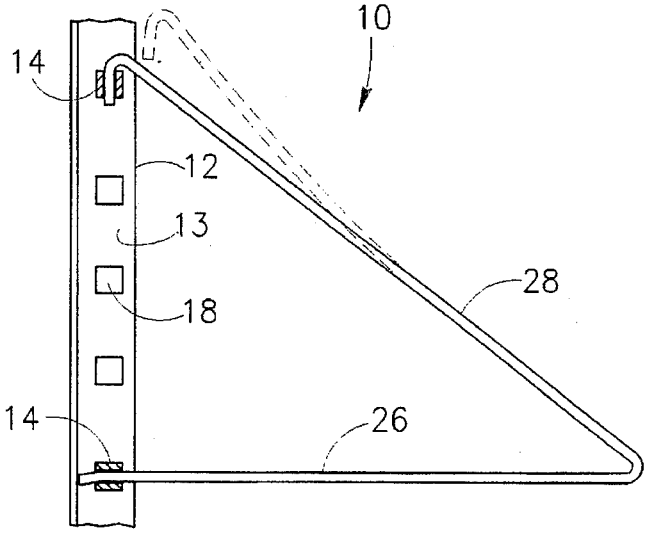
Figure 1I:
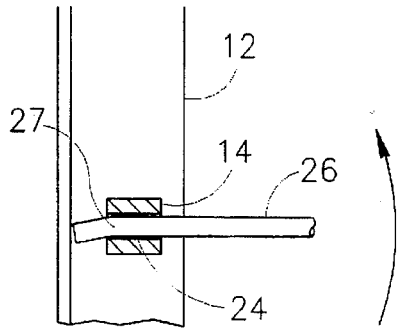
Figure 2A:
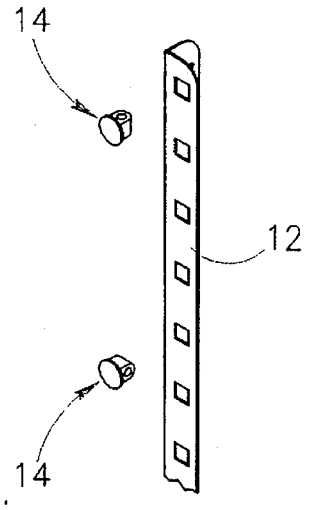
FIGS. 2*a–d* illustrate a method of construction of a pair of shelving supports arranged to support a shelf (FIG. 2*d*)
Figure 2A:
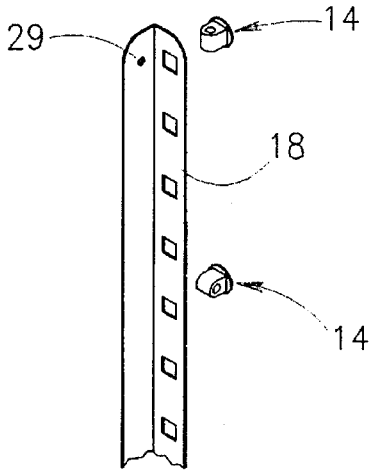
Figure 2B:
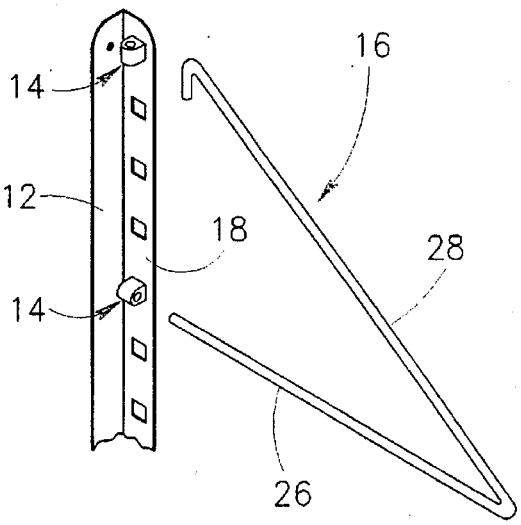
Figure 2B:
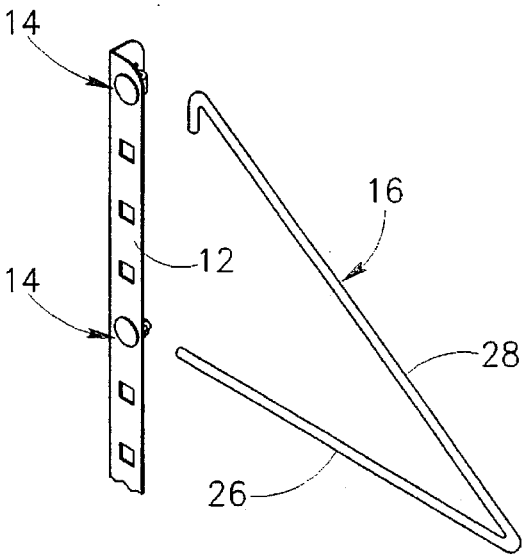
Figure 2C:
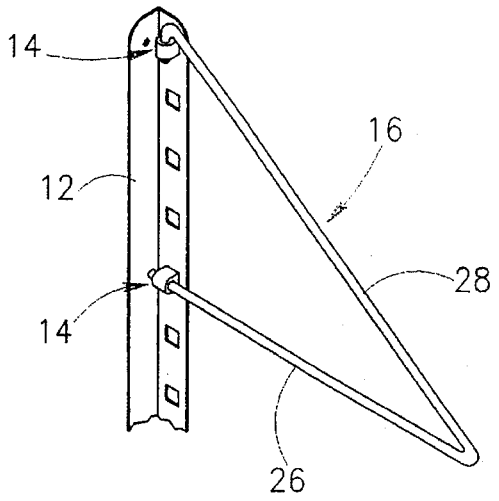
Figure 2C:
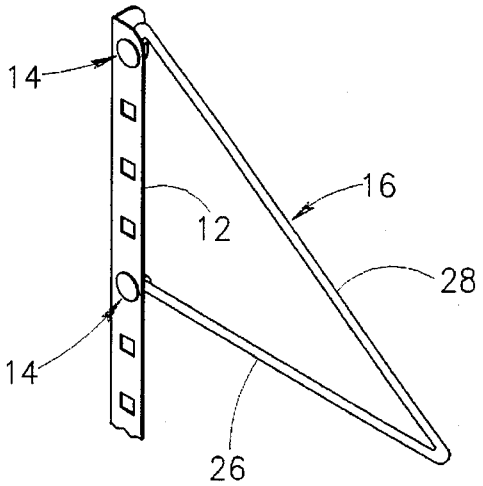
Figure 2D:
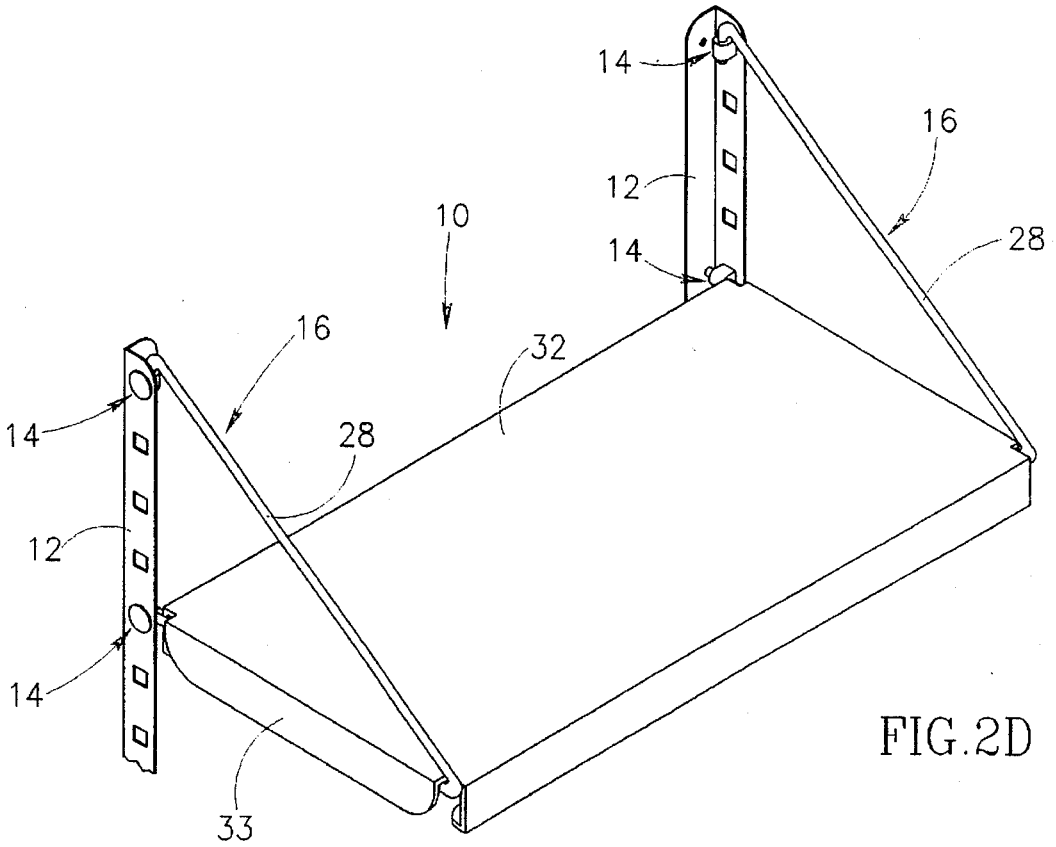

FIGS. 1*e–i* illustrate a modified lower support leg 26, which provides a locking feature when inserted in connector 14. As shown in FIG. 1*e*, lower support leg 26 is bent slightly downward to form a knee 27 near its end. Hole 24 of connector 14 is provided with an oversize diameter, so that knee 27 passes through it (FIG. 1*f*) when lower support leg 26 is rotated into a gentle downward slope from wall bracket 12 (FIG. 1*g*). The upper end of support leg 28 is hooked into upper connector 14 under tension (FIG. 1*h*) after lower support leg 26 is raised slightly to a lateral orientation, such that knee 27 locks it in connector 14 (FIG. 1*i*), in a secure, non-removable fashion. The shelf system can easily be disassembled by reversing these steps.

As shown in FIGS. 2*a–d*, shelving support system 10 features a simplified method of construction, using the common connectors 14, pairs of which are oriented orthogonally to each other. The method commences by fastening a pair of oppositely-facing wall brackets 12 to a wall using mounting holes 29, inserting connectors 14 in wall brackets 12 (FIG. 2*a*), locking shelf hangers 16 in connectors 14 (FIG. 2*b–c*), and placing a folded end 33 of shelf 32 over lower legs 26 of shelf hanger 16. The uniform pattern of square apertures 18 in wall bracket 12 enables the shelf 32 height to be easily adjusted, simply by movement of common connector 14, which can be oriented as required. Since connectors 14 have a square cross-section, they are rigidly fixed in square apertures 18, to prevent downward tilting of shelf hanger 16 under load. Upper support legs 28 of shelf hanger 16 serve as shelf bookends. The shelving support system components are reversible, i.e., suited to right or left-handed installation.

As will be appreciated, the strength of materials used in shelving support system 10 is designed in accordance with loading requirements. Shelf 32 can be dimensioned as required.

Figure 3A:
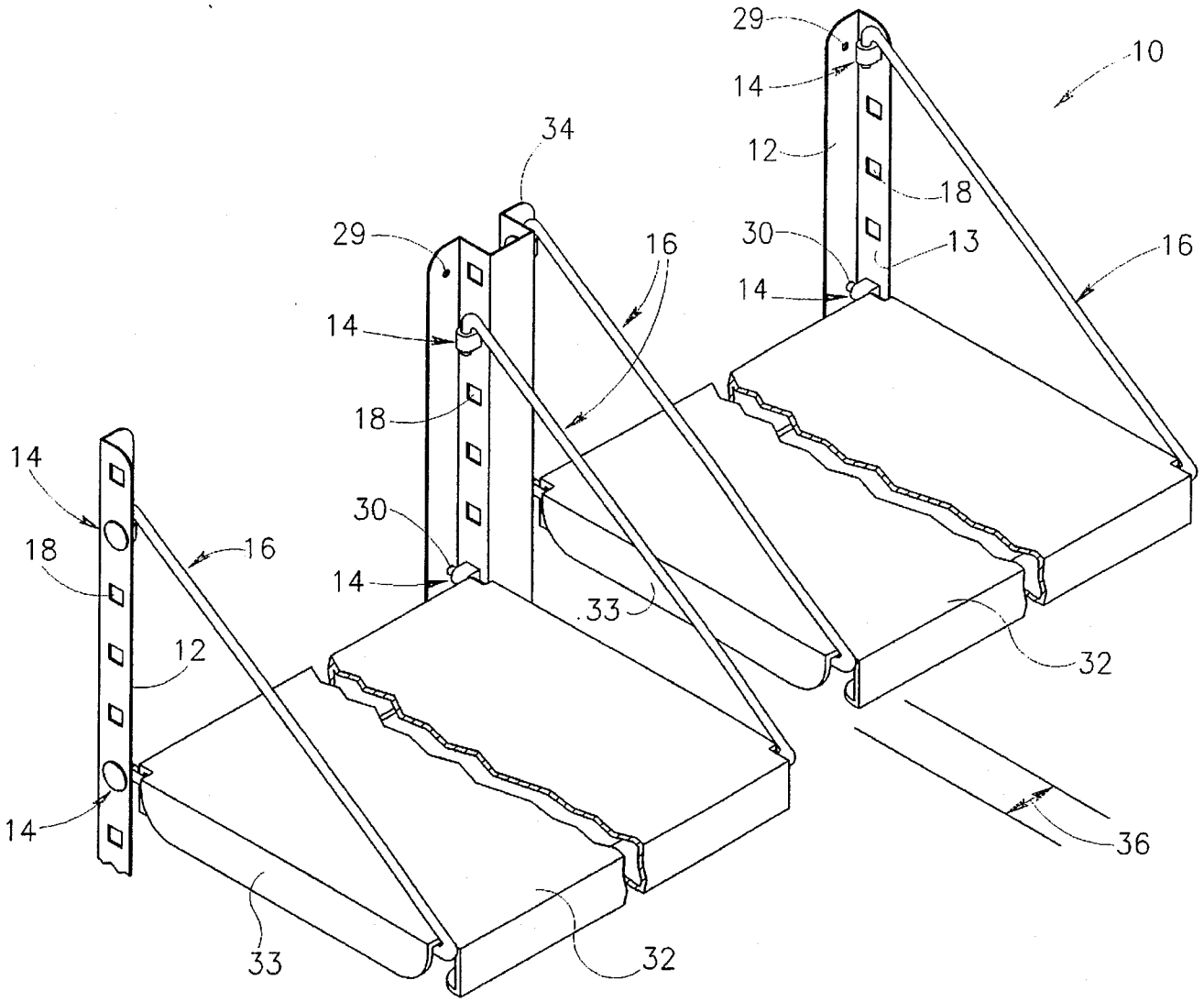
FIGS. 3*a–b* illustrate a shelving system embodiment using an intermediate wall bracket in a staggered shelf layout.
Figure 3B:
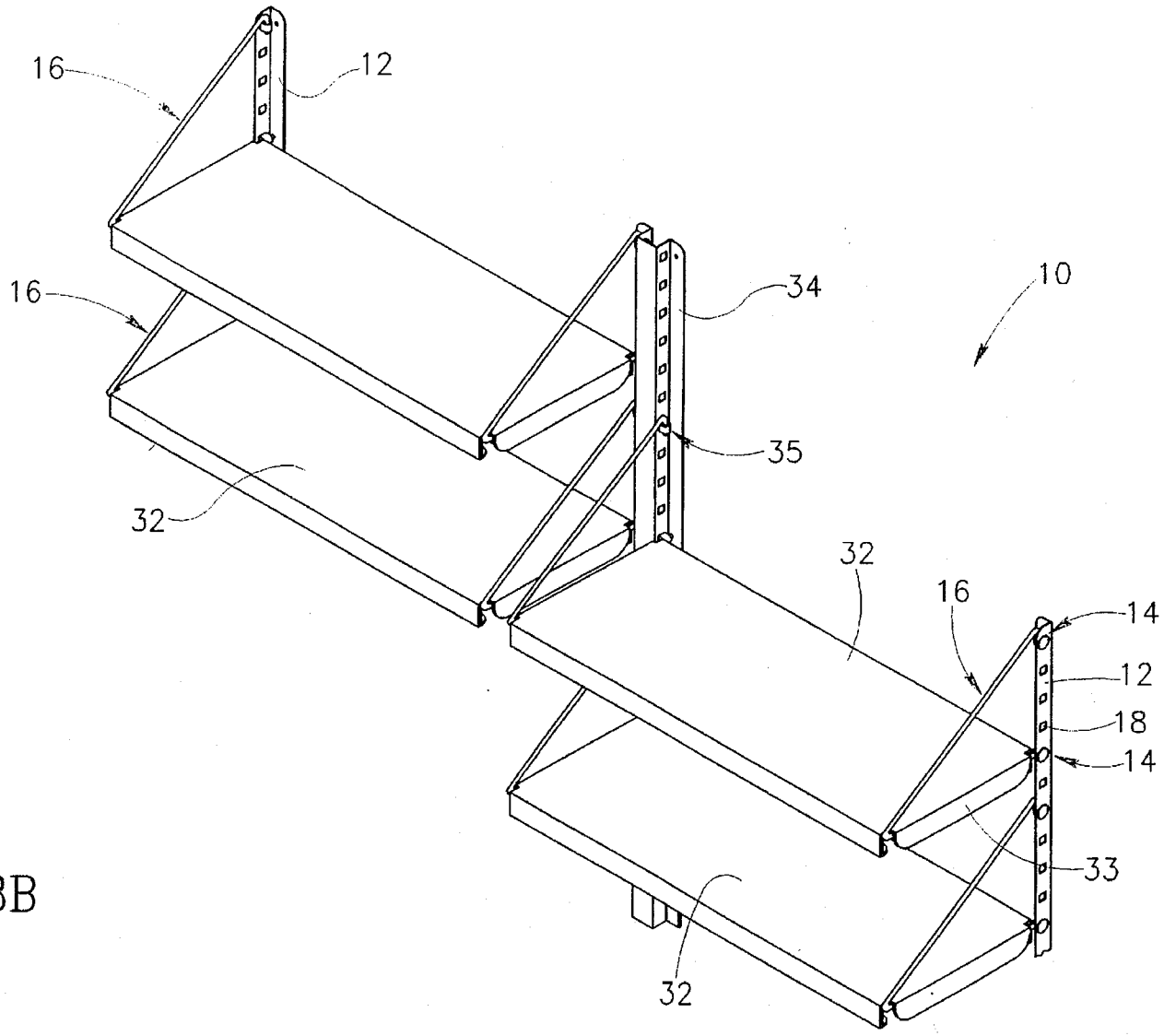

FIGS. 3*a–b* illustrate a shelving system 10 embodiment using an intermediate wall bracket 34 in a staggered height shelf layout. In this arrangement, each connector 14 fits through an aperture 18 formed in a U-shaped intermediate wall bracket 34. Since apertures 18 are formed opposite one another, shelves 32 may be arranged at equal heights (FIG. 3*b*) using a double-ended connector 35 (FIGS. 5*a–c*) which fits through a pair of apertures 18. The gap 36 developed between adjacent shelf hangers 16 by the design of intermediate wall bracket 34 allows for placement of shelves 32 end-to-end. FIG. 3*b* illustrates use of standard wall brackets 12 of equal length together with an intermediate wall bracket 34 of greater length, to provide staggered and equal height shelf 32 layouts.

Figure 4A:
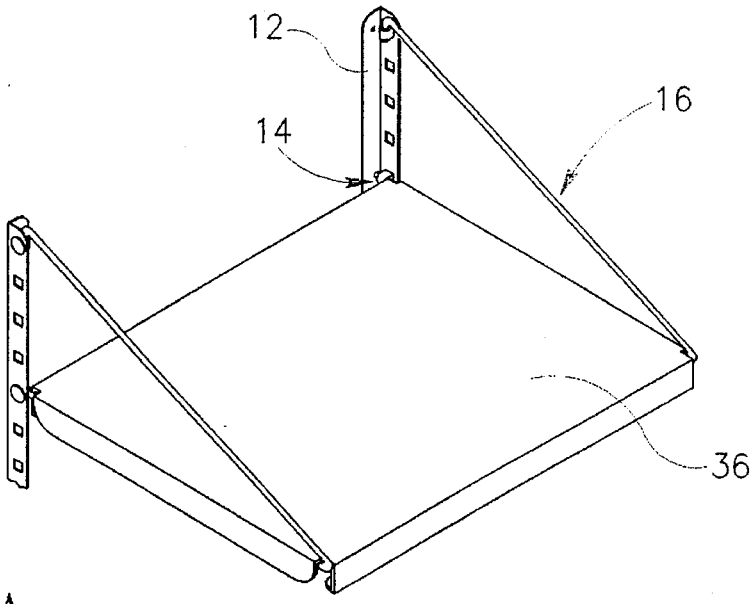
FIGS. 4*a–d* illustrate a shelving system embodiment for use as a closet organizer system.
Figure 4B:
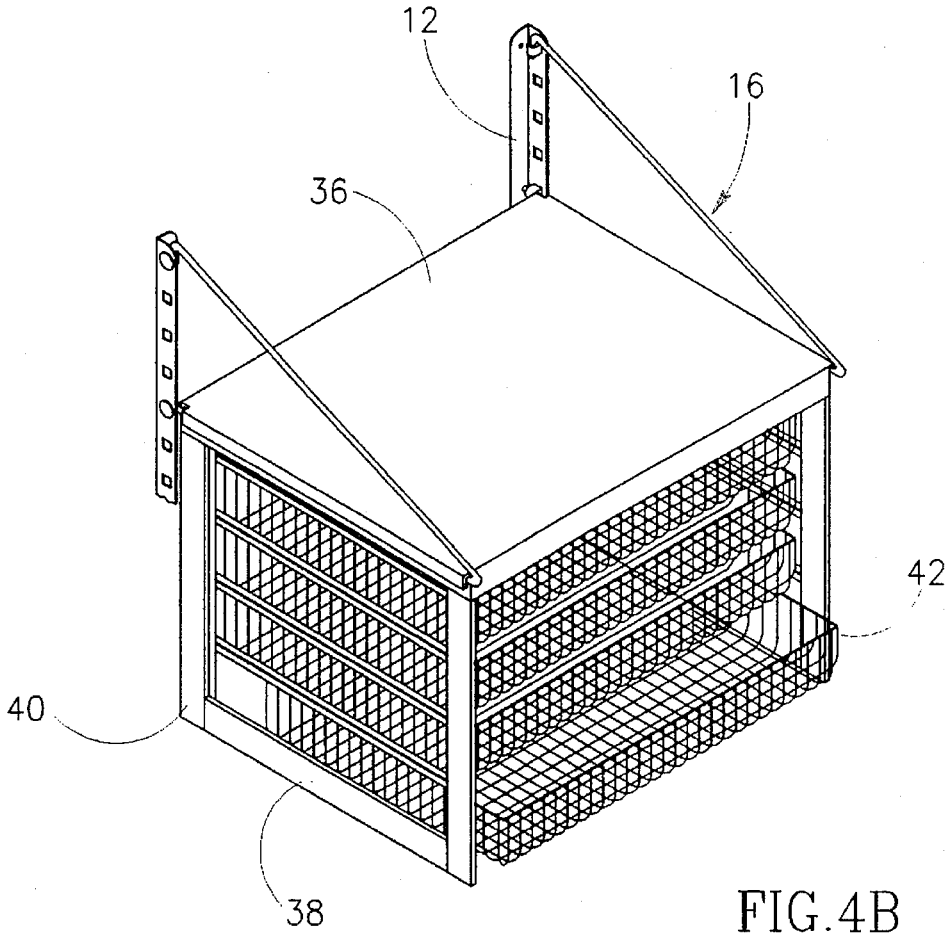
Figure 4C:
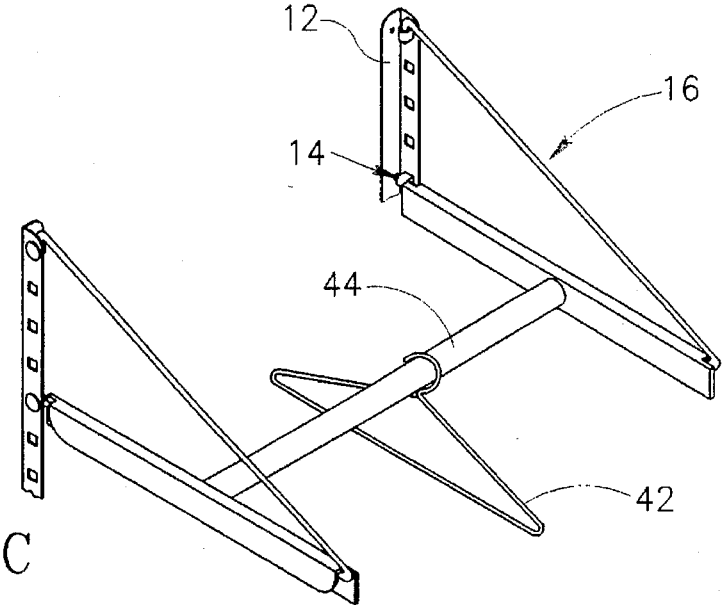
Figure 4D:
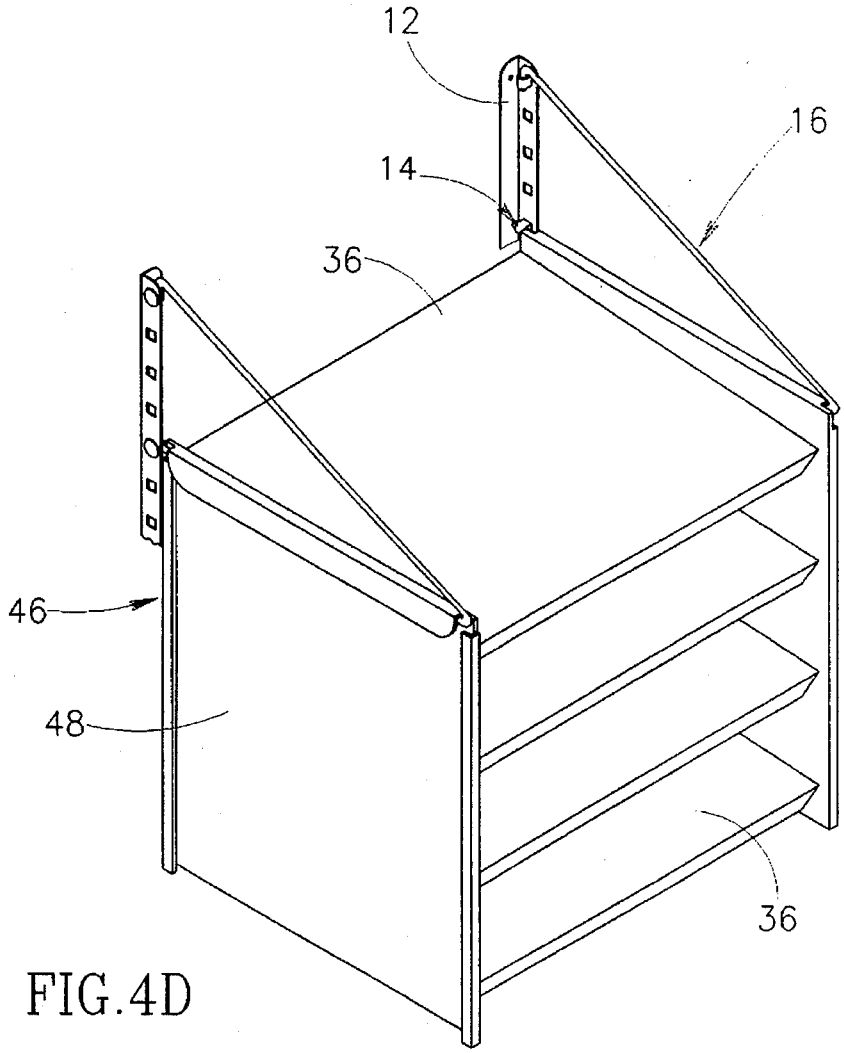

In FIGS. 4*a–d*, there is shown a shelving support system embodiment for use as a closet organizer system. In this arrangement, specific components are designed for convenient storage of clothing, shoes, and other personal items. As shown in FIG. 4*a*, shelf 36 has increased depth, and can be provided with ends which clip onto hangers 16. As shown in FIG. 4*b*, a modular unit 38 can be provided with a frame 40 having slidable drawers 42 mounted underneath shelf 36, with unit 38 supported by hangers 16. FIG. 4*c* shows a clothes hanger 42 supported by a clothes bar 44, which clips onto hangers 16 at it ends. FIG. 4*d* shows a modular shelf unit 46 with a plurality of shelves supported from hangers 16, by side panels 48, which clip onto hangers 16. For efficient closet space utilization, wall bracket 12 can be of such length as to reach from floor to ceiling.

Figure 5A:
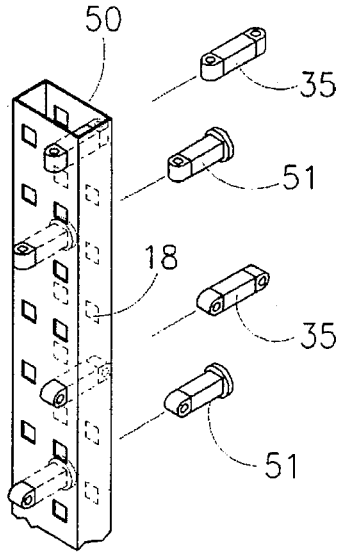
FIGS. 5*a–c* illustrate a method of construction of a free-standing shelving unit using a rectangular-shaped upright.
Figure 5B:
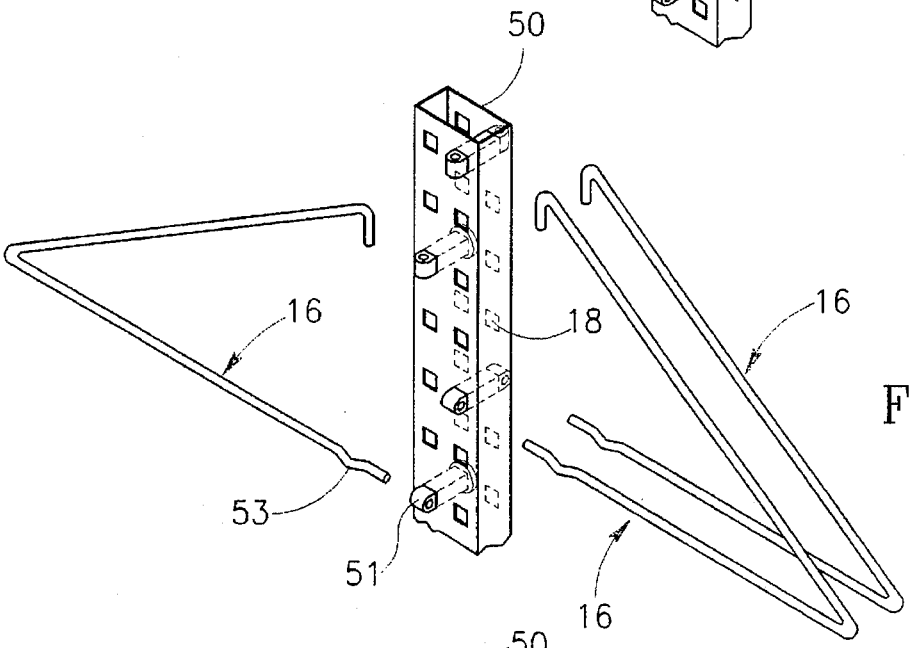
Figure 5C:
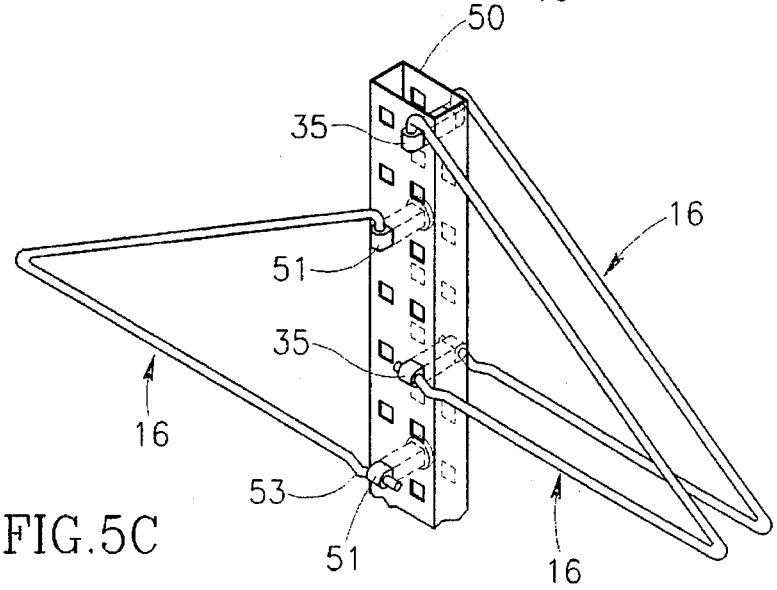

In FIGS. 5*a–c*, there is illustrated a method of construction of a free-standing shelving unit (FIG. 7) using a rectangular or square-shaped upright 50, typically manufactured of steel, or plastic sections. The construction features use of double-ended connectors 35 for attaching shelf hangers 16 at equal heights, and use of extended, standard-type connectors 51 for attaching shelf hangers 16 at differing heights, in a staggered shelf layout. Similar to connector 14, connector 51 is locked in position in aperture 18 between oversize head 15 and an end of shelf hanger 16, while connectors 35 are locked in position in aperture 18 between a pair of shelf hanger 16 ends.

Since the free-standing unit does not use wall bracket 12 as a stop for shelf hangers 16, each of them has a bent section 53 which abuts connectors 51, to provide this function.

Figure 6A:
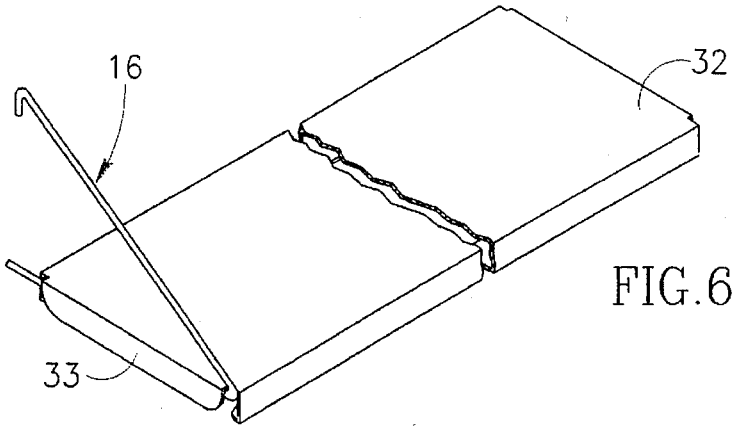
FIGS. 6*a–d* illustrate different shelf material types.
Figure 6B:
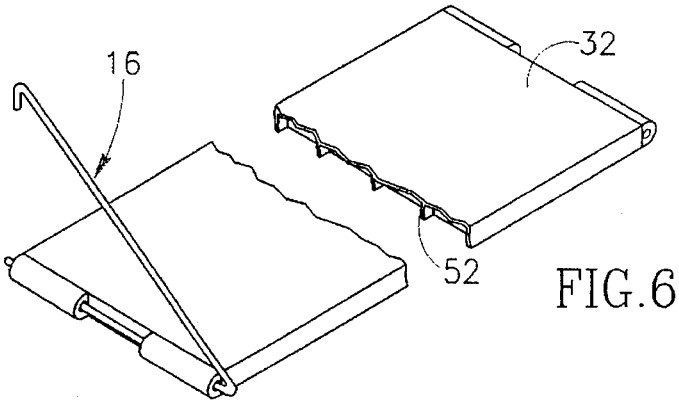
Figure 6C:
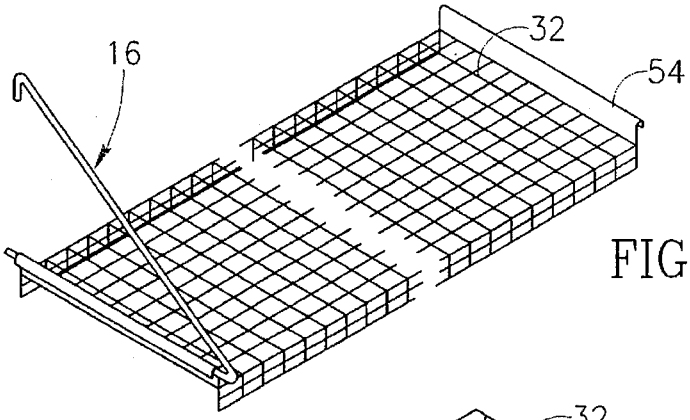
Figure 6D:
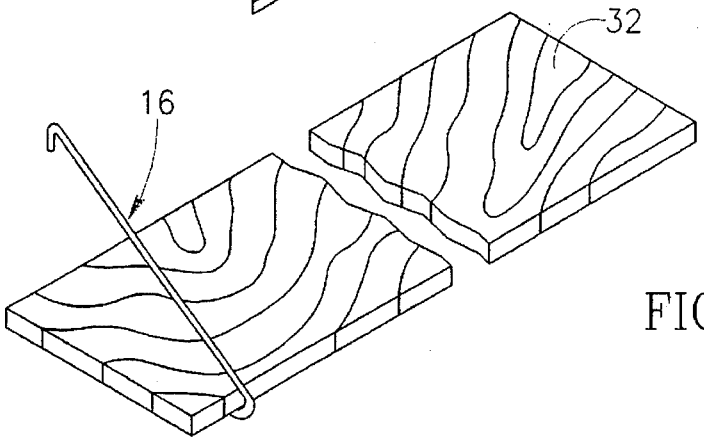

In FIGS. 6*a–d*, there are illustrated different shelf material types, including metal (FIG. 6*a*), plastic with stiffening ribs 52 (FIG. 6*b*), an open metal wire grid (FIG. 6*c*) with folded sheet metal ends 54, and wood (FIG. 6*d*).

Figure 7:
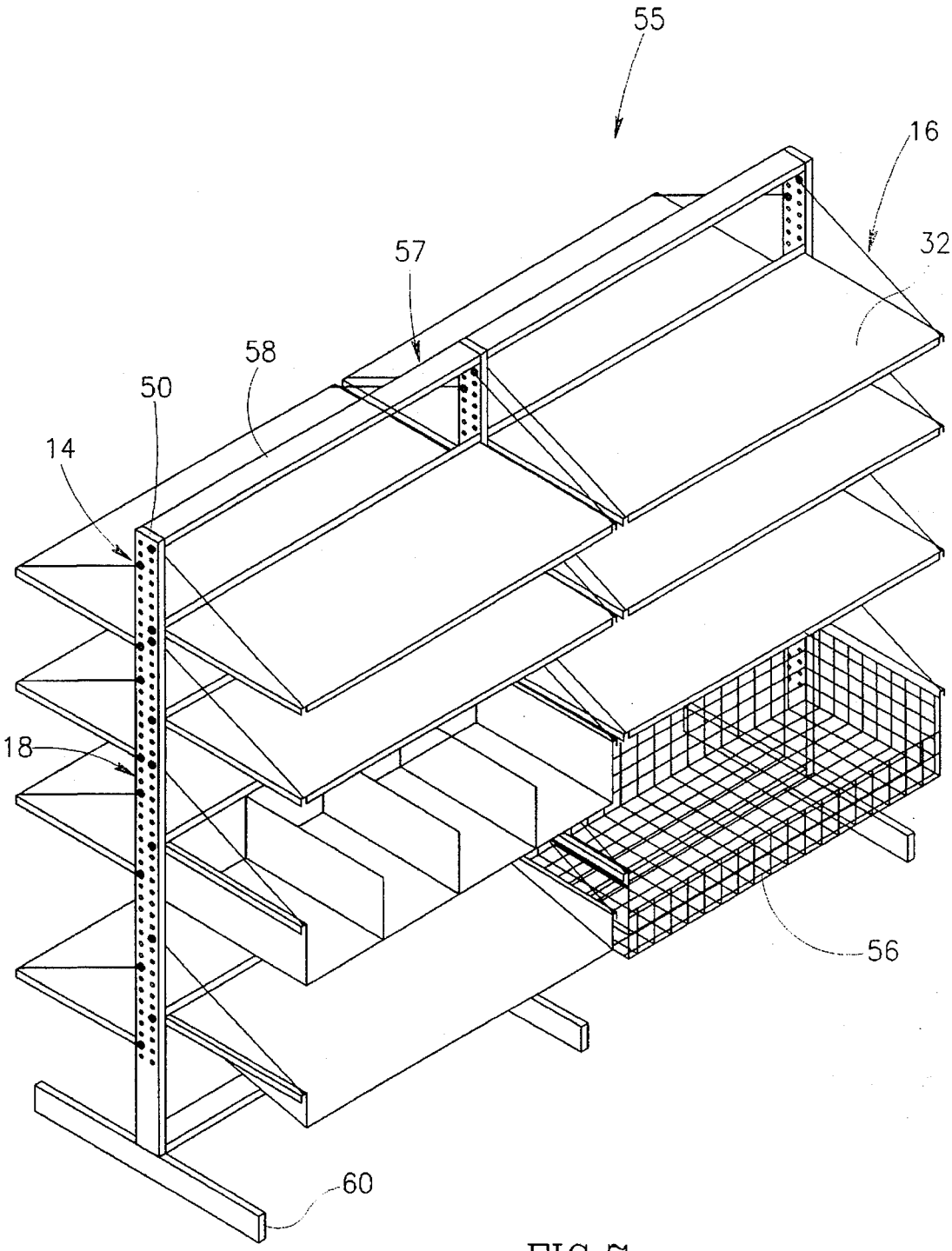
FIG. 7 illustrates a free-standing unit showing different types of shelf and storage bin arrangements.

In FIG. 7, there is illustrated a free-standing unit 55 showing different types of shelf 32 and storage bin 56 arrangements, attached to rectangular upright 50, which is supported by a framework 57 including cross-pieces 58 and base legs 60. The simplicity of assembly makes free-standing unit 55 especially useful In display and storage applications, since store personnel typically assemble these displays, and often rearrange them. Many different wall-supported or free-standing units can be designed.

Figure 8:
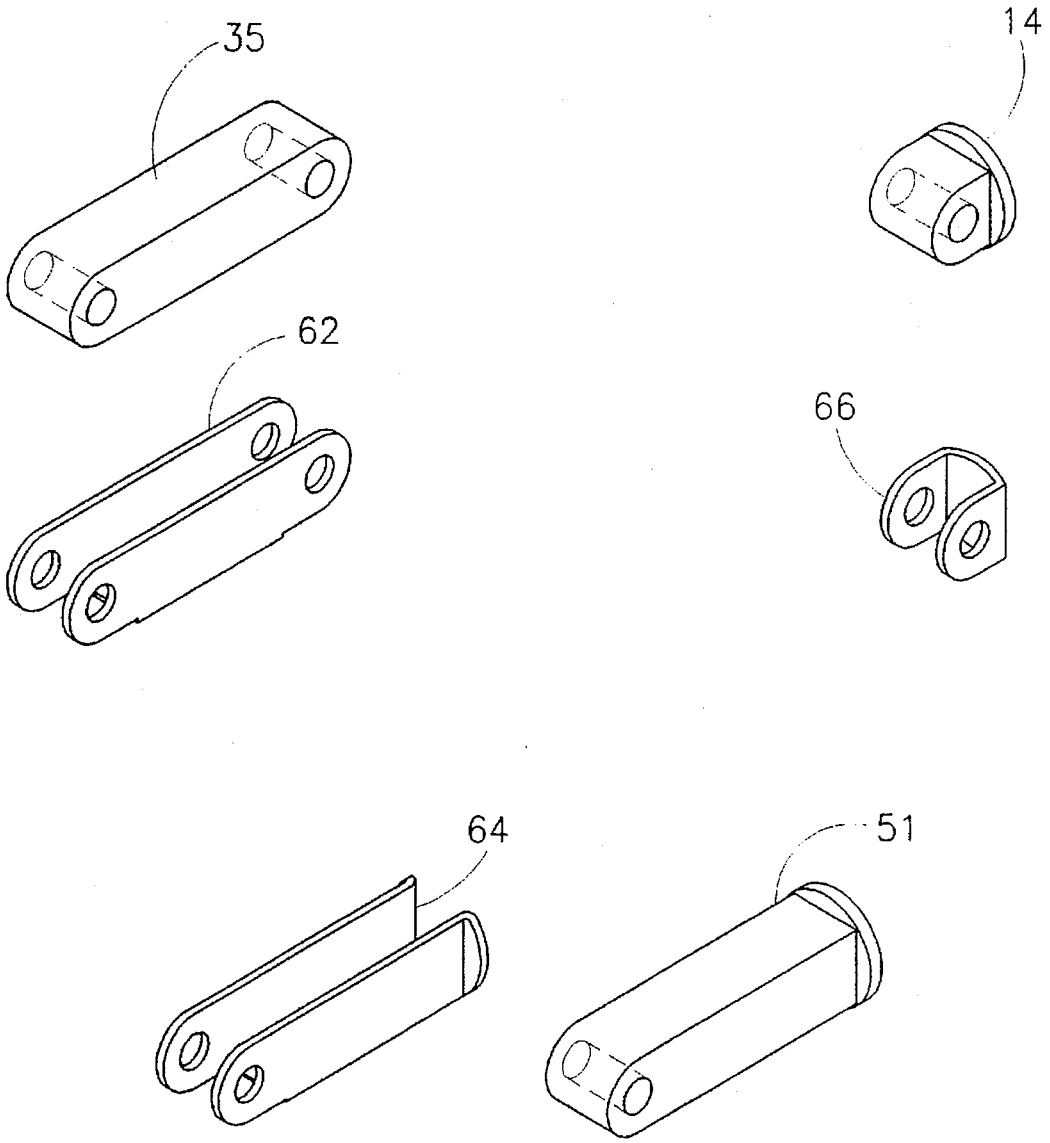
FIG. 8 illustrates alternate connector constructions.

In FIG. 8, there are illustrated alternate construction of connectors for use in shelving system 10. Connector 62 is a double-ended connector, formed as a pair of folded leaves, with a space between them. Typically, connector 62 is manufactured of pressed steel, which can also be used to manufacture alternative connectors 64,66. Extended, standard-type connector 51 is also shown.

Figure 9:
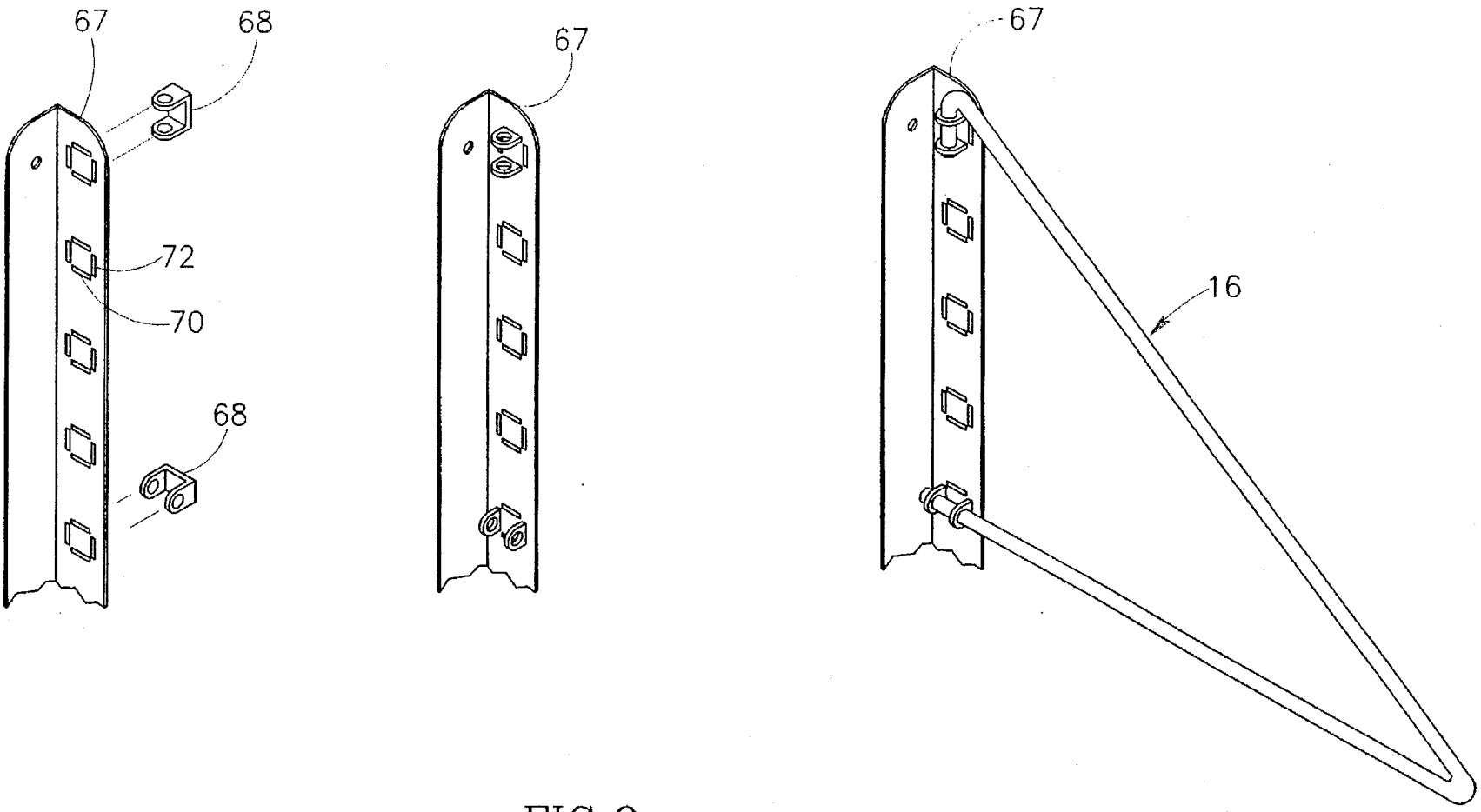
FIG. 9 illustrates an alternative wall bracket and connector arrangement.

In FIG. 9, there is illustrated an alternative wall bracket 67 for use with connector 68. Wall bracket 67 has formed therein a set of orthogonally oriented slots 70, 72 sized to fit therein the lugs of connector 68.

In summary, the inventive shelving support system design features sturdy, easily constructed shelving units for homes, stores and offices. Many designs and layouts are possible.

Having described the invention with regard to the embodiments thereof, it is to be understood that the description is not meant as a limitation, since further modifications may now become apparent to those skilled in the art, and it is intended to cover such modifications as fall within the scope of the appended claims.

I claim:

1. A shelving support system comprising:

an upright member defining a vertical support;

a V-shaped shelf hanger having legs for attachment of each of its terminal ends to said upright member; and a pair of connector means for connecting, respectively, an upper support leg and a lower leg of said V-shaped shelf hanger to said upright member such that said shelf hanger extends from said upright member, said lower leg being connected to said upright member in non-rotatable fashion and being suspended substantially horizontal thereto by the upper support leg for supporting a shelf end resting thereon, wherein said upright member comprises a wall bracket having formed along at least one face thereof a plurality of apertures, each of said pair of connector means comprises a fastener integrally formed with an oversize head and lug, for push-fit insertion into one of said apertures, and each of said shelf hanger legs is wire-shaped, each of said terminal ends thereof being removably insertable in a hole formed in said fastener lug, a pair of said fastener lugs having said holes oriented at 90° to one another, one of said holes being vertically oriented, said upper support leg end being bent vertically to fit within said vertically oriented fastener lug hole.

2. The system of claim 1 wherein said upright member comprises an L-shaped wall bracket.

3. The system of claim 1 wherein said upright member comprises a rectangular section having a plurality of apertures extending through opposite faces.

4. The system of claim 3 wherein said connector means comprises a fastener formed as a lug having holes formed therein at either end.

5. The system of claim 1 wherein said shelf hanger comprises a pair of shelf hangers, and wherein at least a pair of said shelf hangers supports a closet organizer system comprising a modular unit having a plurality of shelves.

6. The system of claim 1 wherein said shelf hanger comprises a pair of shelf hangers, and wherein at least a pair of said shelf hangers supports a closet organizer system comprising a clothes bar.

7. The system of claim 1 wherein said lower support leg end fits non-rotatably within a horizontal fastener lug hole.

8. The system of claim 7 wherein said lower support leg end is formed with a slight bend providing a knee, to lock said lower support leg end in said connector when connected together.

9. The system of claim 1 wherein a pair of appropriately spaced apart shelf hanger lower legs provides a shelf support.

10. The system of claim 1 wherein said shelf hanger comprises a pair of shelf hangers, a plurality of said shelf hanger pairs being provided at staggered heights in a shelving unit layout.

11. The system of claim 1 wherein said shelf hanger comprises a pair of shelf hangers, and wherein said upright member supports said pair of shelf hangers in a free-standing shelving unit.

12. The system of claim 1 wherein said shelf hanger comprises a pair of shelf hangers, and wherein at least a pair of said shelf hangers supports a closet organizer system comprising a modular unit having slidable drawers.

13. A method of constructing a shelving support system comprising the steps of:

providing an upright member defining a vertical support;

providing a V-shaped shelf hanger having legs for attachment of each of its terminal ends to said upright member; and connecting, by means of a pair of connectors, an upper support leg and a lower leg of said V-shaped hanger to said upright member such that said shelf hanger extends from said upright member, said lower leg being connected to said upright member in non-rotatable fashion and being suspended substantially horizontal thereto by the upper support leg for supporting a shelf end resting thereon, wherein said upright member comprises a wall bracket having formed at least along one face thereof a plurality of apertures;

each of said pair of connector means comprises a fastener integrally formed with an oversize head and lug, for push-fit insertion into one of said apertures; and each of said shelf hanger legs is wire-shaped, each of said terminal ends thereof being removably insertable in a hole formed in said fastener lug, a pair of said fastener lugs having said holes oriented at 90° to one another, one of said holes being vertically oriented, said upper support leg end being bent vertically to fit within said vertically oriented fastener lug hole, with said lower support leg end being formed with a slight bend providing a knee, and wherein said connecting step comprises:

rotating said lower leg slightly downward;

passing its end through said fastener lug hole, and raising said lower leg upward to lock said lower support leg in said connector when connected together.

* * * * *